US006832482B2

(12) United States Patent
Martling et al.

(10) Patent No.: US 6,832,482 B2
(45) Date of Patent: Dec. 21, 2004

(54) PRESSURE RAM DEVICE ON A GAS TURBINE COMBUSTOR

(75) Inventors: Vincent C. Martling, Boynton Beach, FL (US); Zhenhua Xiao, Palm Beach Gardens, FL (US)

(73) Assignee: Power Systems Mfg, LLC, Jupiter, FL (US)

( * ) Notice: Subject to any disclaimer, the term of this patent is extended or adjusted under 35 U.S.C. 154(b) by 8 days.

(21) Appl. No.: 10/302,229

(22) Filed: Nov. 22, 2002

(65) Prior Publication Data

US 2003/0233833 A1 Dec. 25, 2003

Related U.S. Application Data

(63) Continuation-in-part of application No. 10/064,248, filed on Jun. 25, 2002, now Pat. No. 6,484,509.

(51) Int. Cl.[7] ..... F23R 3/04
(52) U.S. Cl. ..... 60/737; 60/759
(58) Field of Search ..... 60/737, 738, 752, 60/759, 760, 804

(56) References Cited

U.S. PATENT DOCUMENTS

RE23,149 E 9/1949 Lubbock et al.
2,531,810 A * 11/1950 Fyffe ..... 60/759
3,589,128 A * 6/1971 Sweet ..... 60/759
5,117,636 A 6/1992 Bechtel et al.
5,575,146 A 11/1996 Borkowicz et al.
6,427,446 B1 8/2002 Kraft et al.
6,446,438 B1 * 9/2002 Kraft et al. ..... 60/737

* cited by examiner

*Primary Examiner*—Louis J. Casaregola
(74) *Attorney, Agent, or Firm*—Brian R. Mack

(57) ABSTRACT

A method for providing cooling air to the venturi and the combustion chamber in a low NOx emission combustor as used in a gas turbine engine that includes the steps of providing an annular air passage surrounding said combustion chamber and venturi where said cooling air under pressure enters the combustion chamber/venturi near the aft portion of the combustion chamber, passing the air along the combustion chamber, past the venturi where the air exits near the front portion of the convergent area of the venturi. The method prevents any channel/passage cooling air from being received into the combustion chamber, and at the same time, introduces the outlet of the cooling air, after the air has passed over the combustion chamber of the venturi and has been heated, back into the premix chamber thereby improving the efficiency of the combustor while reducing and lowering NOx emission in the combustion process. In an alternate embodiment, a combustion system is disclosed incorporating a shaped deflector to direct cooling air into a cooling passageway of a venturi. The deflector is configured to provide a cooling system with increased total pressure to increase overall cooling effectiveness.

14 Claims, 11 Drawing Sheets

PRESSURE RAM DEVICE ON A GAS TURBINE COMBUSTOR

This application is a continuation-in-part of U.S. patent application Ser. No. 10/064,248, filed Jun. 25, 2002 now U.S. Pat. No. 6,484,509 and assigned to the same assignee hereof.

BACKGROUND OF THE INVENTION

1. Field of the Invention

This invention relates generally to a method for cooling the combustion chamber and venturi used in a gas turbine engine for reducing nitric oxide emissions and to a structure for improved cooling of a venturi cooling passageway. Specifically a method is disclosed for cooling the combustion chamber/venturi to lower nitric oxide (NOx) emissions by introducing preheated cooling air into the premix chamber for use in the combustion process.

2. Description of Related Art

The present invention is used in a dry, low NOx gas turbine engine typically used to drive electrical generators. Each combustor includes an upstream premix fuel/air chamber and a downstream combustion chamber separated by a venturi having a narrow throat constriction that acts as a flame retarder. The invention is concerned with improving the cooling of the combustion chamber which includes the venturi walls while at the same time reducing nitric oxide emissions.

U.S. Pat. No. 4,292,801 describes a gas turbine combustor that includes upstream premix of fuel and air and a downstream combustion chamber.

U.S. Pat. No. 5,117,636 and U.S. Pat. No. 5,285,631 deal with cooling the combustion chamber wall and the venturi walls. The patents state that there is a problem with allowing the cooling air passage to dump into the combustion chamber if the passage exit is too close to the venturi throat. The venturi creates a separation zone downstream of the divergent portion which causes a pressure difference thereby attracting cooling air which can cause combustion instabilities. However, it is also essential that the venturi walls and combustion chamber wall be adequately cooled because of the high temperatures developed in the combustion chamber.

The present invention eliminates the problem discussed in the prior art because the cooling circuit for the venturi has been adjusted such that the cooling air no longer dumps axially aft and downstream of the venturi throat into the combustion zone. In fact, cooling air flows in the opposite direction so that the air used for cooling the combustion chamber and the venturi is forced into the premix chamber upstream of the venturi, improving the efficiency of the overall combustion process while eliminating any type of cooling air recirculation separation zone aft of the venturi as discussed in the U.S. Pat. No. 5,117,636.

Recent government emission regulations have become of great concern to both manufacturers and operators of gas turbine combustors. Of specific concern is nitric oxide (NOx) due to its contribution to air pollution.

It is well known that NOx formation is a function of flame temperature, residence time, and equivalence ratio. In the past, it has been shown that nitric oxide can be reduced by lowering flame temperature, as well as the time that the flame remains at the higher temperature. Nitric Oxide has also been found to be a function of equivalence ratio and fuel to air (f/a) stoichiometry. That is, extremely low f/a ratio is required to lower NOx emissions. Lowering f/a ratios do not come without penalty, primarily the possibility of "blow-out". "Blow-Out" is a situation when the flame, due to its instability, can no longer be maintained. This situation is common as fuel-air stoichiometry is decreased just above the lean flammability limit. By preheating the premix air, the "blow-out" flame temperature is reduced, thus allowing stable combustion at lower temperatures and consequently lower NOx emissions. Therefore, introducing the preheated air is the ideal situation to drive f/a ratio to an extremely lean limit to reduce NOx, while maintaining a stable flame.

In a dual-stage, dual-mode gas turbine system, the secondary combustor includes a venturi configuration to stabilize the combustion flame. Fuel (natural gas or liquid) and air are premixed in the combustor premix chamber upstream of the venturi and the air/fuel mixture is fired or combusted downstream of the venturi throat. The venturi configuration accelerates the air/ fuel flow through the throat and ideally keeps the flame from flashing back into the premix region. The flame holding region beyond the throat in the venturi is necessary for continuous and stable fuel burning. The combustion chamber wall and the venturi walls before and after the narrow throat region are heated by the combustion flame and therefore must be cooled. In the past, this has been accomplished with back side impingement cooling which flows along the back side of the combustion wall and the venturi walls where the cooling air exits and is dumped into combustion chamber downstream of the venturi.

The present invention overcomes the problems provided by this type of air cooling passage by completely eliminating the dumping of the cooling air into the combustion zone downstream of the venturi. The present invention does not permit any airflow of the venturi cooling air into the downstream combustion chamber whatsoever. At the same time the present invention takes the cooling air, which flows through an air passageway along the combustion chamber wall and the venturi walls and becomes preheated and feeds the cooling air upstream of the venturi (converging wall) into the premixing chamber. This in turn improves the overall low emission NOx efficiency.

BRIEF SUMMARY OF THE INVENTION

An improved method for cooling a combustion chamber wall having a flame retarding venturi used in low nitric oxide emission gas turbine engines that includes a gas turbine combustor having a premixing chamber and a secondary combustion chamber and a venturi, a cooling air passageway concentrically surrounding said venturi walls and said combustion chamber wall. A plurality of cooling air inlet openings into said cooling air passageway are disposed near the end of the combustion chamber.

The combustion chamber wall itself is substantially cylindrical and includes the plurality of raised ribs on the outside surface which provide additional surface area for interaction with the flow of cooling air over the combustion cylinder liner. The venturi walls are also united with the combustion chamber and include a pair of convergent/divergent walls intricately formed with the combustion chamber liner that includes a restricted throat portion. The cooling air passes around not only the cylindrical combustion chamber wall but both walls that form the venturi providing cooling air to the entire combustor chamber and venturi. As the cooling air travels upstream toward the throat, its temperature rises.

The cooling air passageway is formed from an additional cylindrical wall separated from the combustion chamber wall that is concentrically mounted about the combustion chamber wall and a pair of conical walls that are concentrically disposed around the venturi walls in a similar configuration to form a complete annular passageway for air to flow around the entire combustion chamber and the entire venturi. The downstream end of the combustion chamber and the inlet opening of the cooling air passageway are separated by a ring barrier so that none of the cooling air in the passageway can flow downstream into the combustion chamber, be introduced downstream of the combustion chamber, or possibly travel into the separated region of the venturi. In fact the cooling air outlet is located upstream of the venturi and the cooling air flows opposite relative to the combustion gas flow, first passing the combustion chamber wall and then the venturi walls. The preheated cooling air is ultimately introduced into the premix chamber, adding to the efficiency of the system and reducing nitric oxide emissions with a stable flame.

The source of the cooling air is the turbine compressor that forces high pressure air around the entire combustor body in a direction that is upstream relative to the combustion process. Air under high pressure is forced around the combustor body and through a plurality of air inlet holes in the cooling air passageway near the downstream end of the combustion chamber, forcing the cooling air to flow along the combustor outer wall toward the venturi, passing the throat of the venturi, passing the leading edge of the venturi wall where there exists an outlet air passageway and a receiving channel that directs air in through another series of inlet holes into the premix chamber upstream of the venturi throat. With this flow pattern, it is impossible for cooling air to interfere with the combustion process taking place in the secondary combustion chamber since there is no exit or aperture interacting with the secondary combustion chamber itself. Also as the cooling air is heated in the passageway as it flows towards the venturi and is introduced into the inlet premix chamber upstream of the venturi, the heated air aides in combustor efficiency to reduce pollutant emissions.

The outer combustor housing includes an annular outer band that receives the cooling air through outlet apertures upstream of the venturi. The air is then directed further upstream through a plurality of inlet air holes leading into the premix chamber allowing the preheated cooling air to flow from the air passageway at the leading venturi wall into the premix area.

The combustion chamber wall includes a plurality of raised rings to increase the efficiency of heat transfer from the combustion wall to the air, giving the wall more surface area for air contact. Although a separate concentric wall is used to form the air cooling passageway around the combustion chamber and the venturi, it is possible in an alternative embodiment that the outer wall of the combustor itself could provide that function.

In an alternate embodiment of the present invention, a combustion system is disclosed that includes a deflector configured to direct cooling air into a venturi cooling passageway. The deflector contains a radial profile for capturing and directing the necessary amount of air into the passageway while minimizing pressure loss, thereby resulting in improved cooling effectiveness and lower operating temperatures.

It is an object of the present invention to reduce nitric oxide (NOx) emissions in a gas turbine combustor system while maintaining a stable flame in a desired operating condition while providing air cooling of the combustor chamber and venturi.

It is another object of this invention to provide a low emission combustor system that utilizes a venturi for providing multiple uses of cooling air for the combustor chamber and venturi.

And yet another object of this invention is to lower the "blow-out" flame temperature of the combustor by utilizing preheated air in the premixing process that results from cooling the combustion chamber and venturi.

And yet a further object of this invention is to provide a gas turbine combustion system utilizing a venturi having increased cooling flow with increased total pressure of the cooling flow, thereby resulting in improved cooling in a venturi cooling passageway.

In accordance with these and other objects, which will become apparent hereinafter, the instant invention will now be described with particular reference to the accompanying drawings.

DETAILED DESCRIPTION OF THE PREFERRED EMBODIMENT

Figure 1:
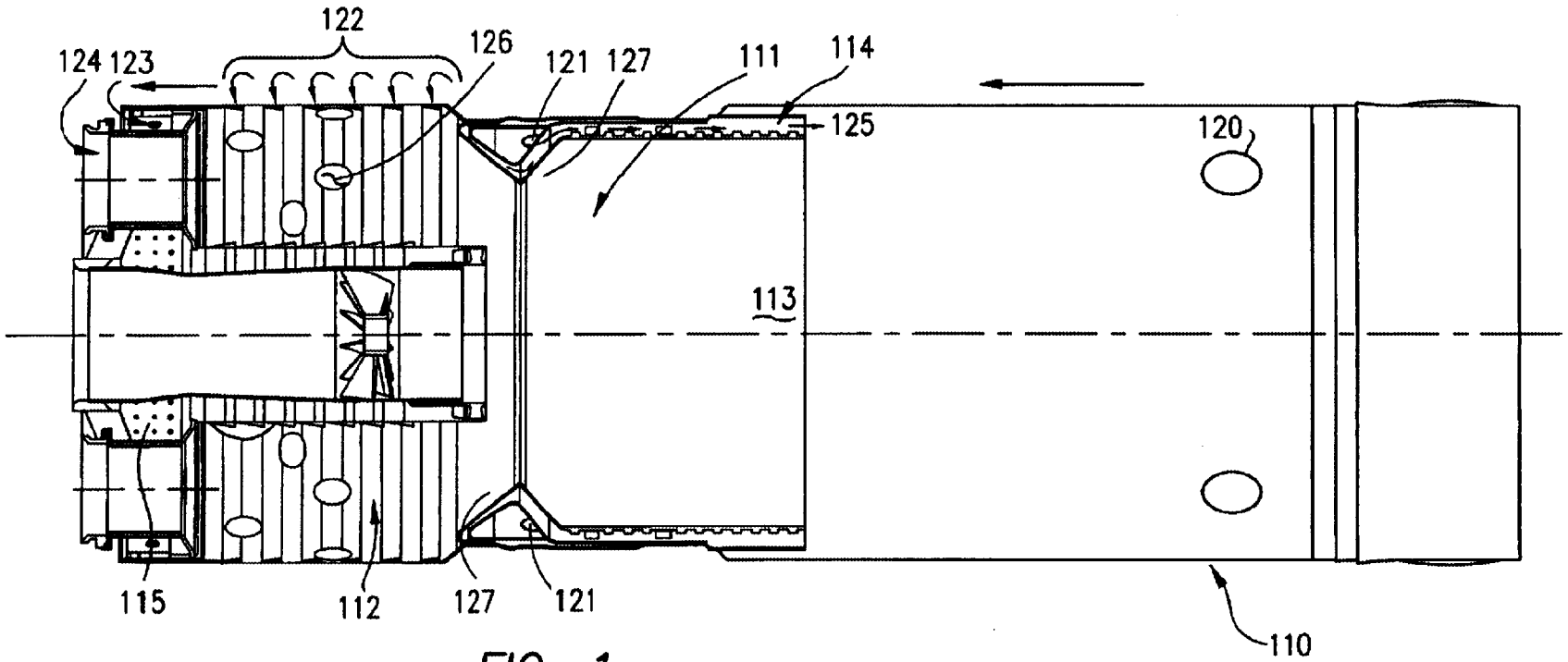
FIG. 1 PRIOR ART
FIG. 1 shows a side elevational view in cross-section of a gas turbine combustion system that represents the prior art, which shows an air cooling passage that empties into and around the combustion chamber.

Referring to FIG. 1, an existing gas turbine combustor well known in the prior art 110 is shown. The combustor 110 includes a venturi 111, a premixing chamber 112 for premixing air and fuel, a combustor chamber 113 and a combustion cap 115. As shown in this prior art combustor, cooling air represented by arrows flows under pressure along the external wall of the venturi 111. The cooling air enters the system through multiple locations along the liner 110. A portion of the air enters through holes 120 while the remainder runs along the outer shell. The cooling air, which is forced under pressure, with the turbine compressor as the source, enters the system through a plurality of holes 121. As seen in FIG. 1 the cooling air impinges and cools the convergent/divergent walls 127 of the venturi 111, which are conically shaped and travel downstream through the cylindrical passage 114 cooling the walls of combustion cylinder chamber 113. The cooling air exits along the combustion chamber wall through annular discharge opening 125. This air is then dumped to the downstream combustion process. A portion of the cooling air also enters the premixing zone through holes 126. The remaining cooling air proceeds to the front end of the liner where it enters through holes 123 and the combustion cap 115. The portion of the cooling air that does not enter through holes 123 enters and mixes the gas and fuel through area 124. U.S. Pat. No. 5,117,636 discusses the prior art configuration of the venturi shown in FIG. 1. Problems are discussed regarding the cooling air exiting adjacent the venturi 111 through passage exit 125 which interferes with the combustion process and mixture based on what the '636 Patent states as a separation zone.

The present invention completely alleviates any of the problems raised in the '636 Patent.

Figure 2:
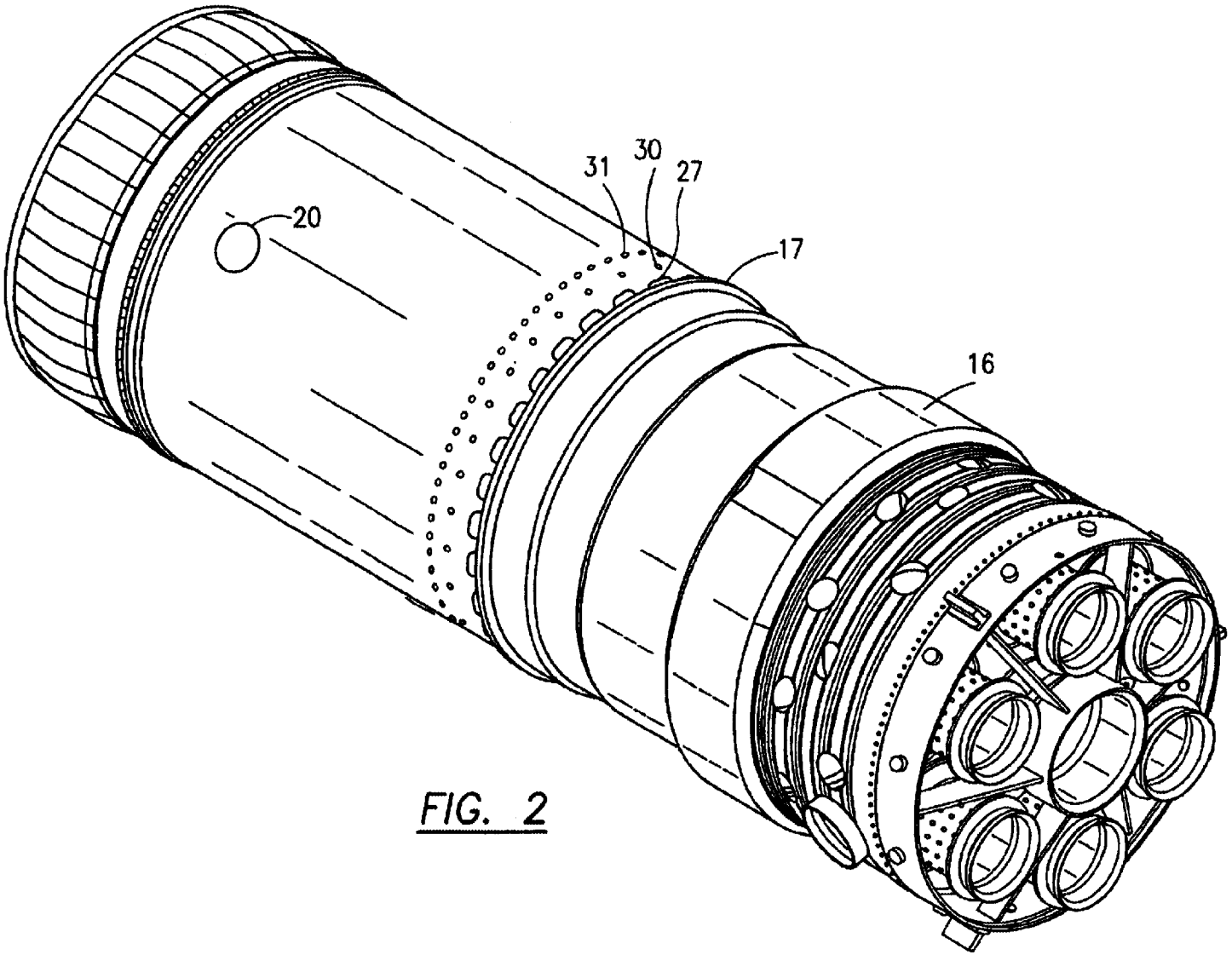
FIG. 2 shows a gas turbine combustion system in a perspective view in accordance with the present invention.
Figure 3:
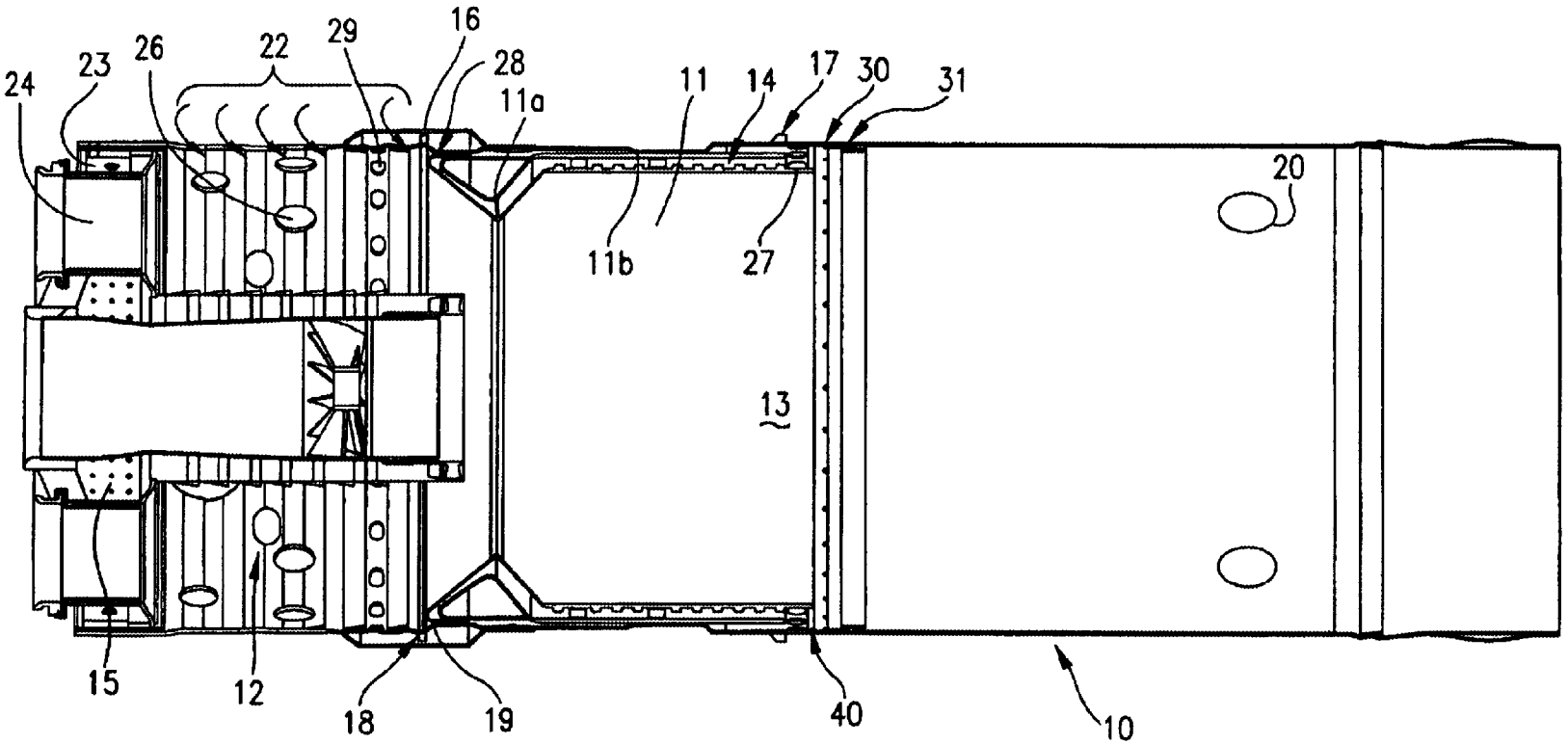
FIG. 3 shows a side elevational view in cross-section of a gas turbine combustor system in accordance with the present invention.

Referring now to FIGS. 2 and 3, the present invention is shown as gas turbine combustor 10 including a venturi 11.

The venturi 11 includes a cylindrical portion which forms the combustor chamber 13 and unitarily formed venturi walls which converge and diverge in the downstream direction forming an annular or circular restricted throat 11*a*. The purpose of the venturi and the restricted throat 11*a* is to prevent flash back of the flame from combustion chamber 13.

Chamber 12 is the premix chamber where air and fuel are mixed and forced under pressure downstream through the venturi throat 11*a* into the combustor chamber 13.

A concentric, partial cylindrical wall 11*b* surrounds the venturi 11 including the converging and diverging venturi walls to form an air passageway 14 between the venturi 11 and the concentric wall 11*b* that allows the cooling air to pass along the outer surface of the venturi 11 for cooling.

Figure 5:
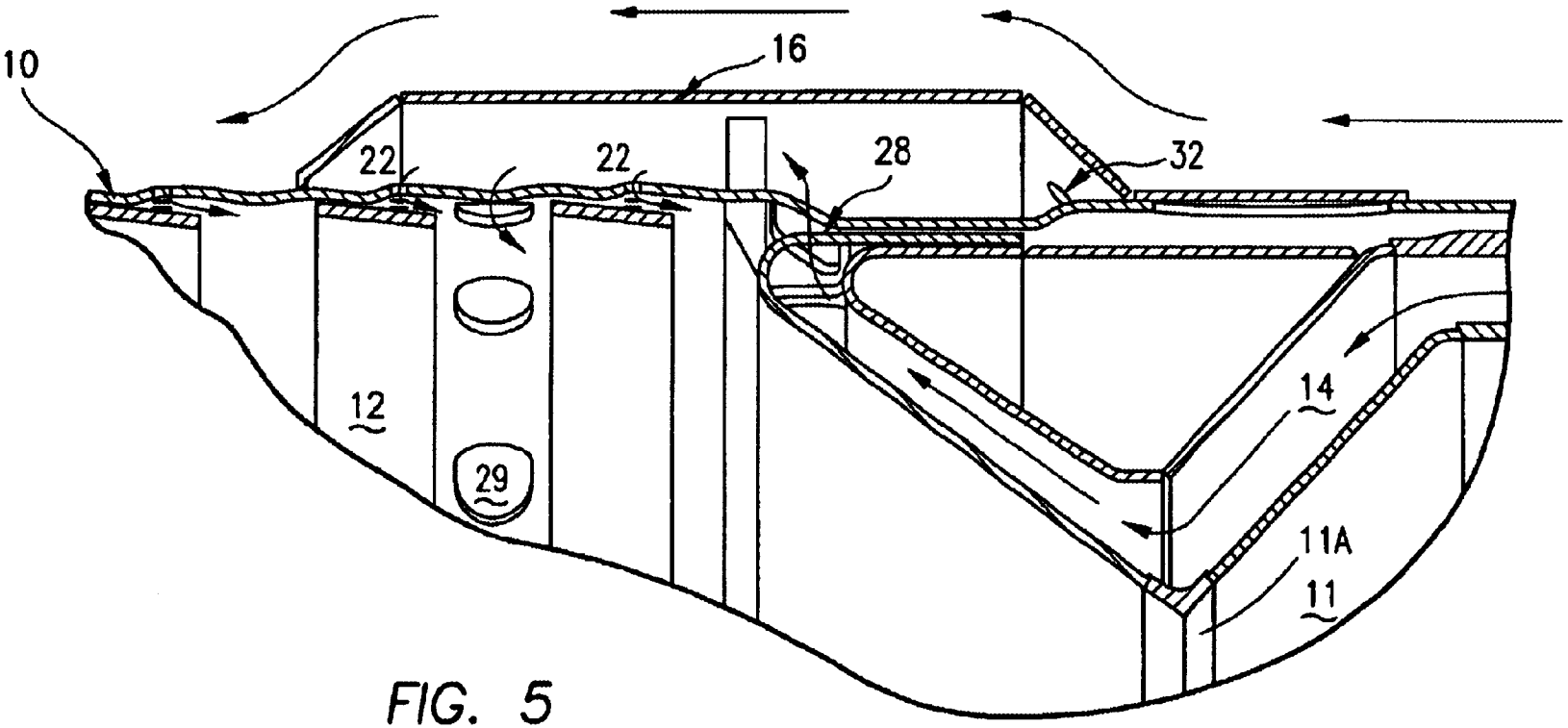
FIG. 5 shows a cross-sectional view, partially cut away of the cooling air passageway at the upstream end of the venturi in the annular bellyband chamber for receiving cooling air for introducing the air into the premix chamber.
Figure 6:
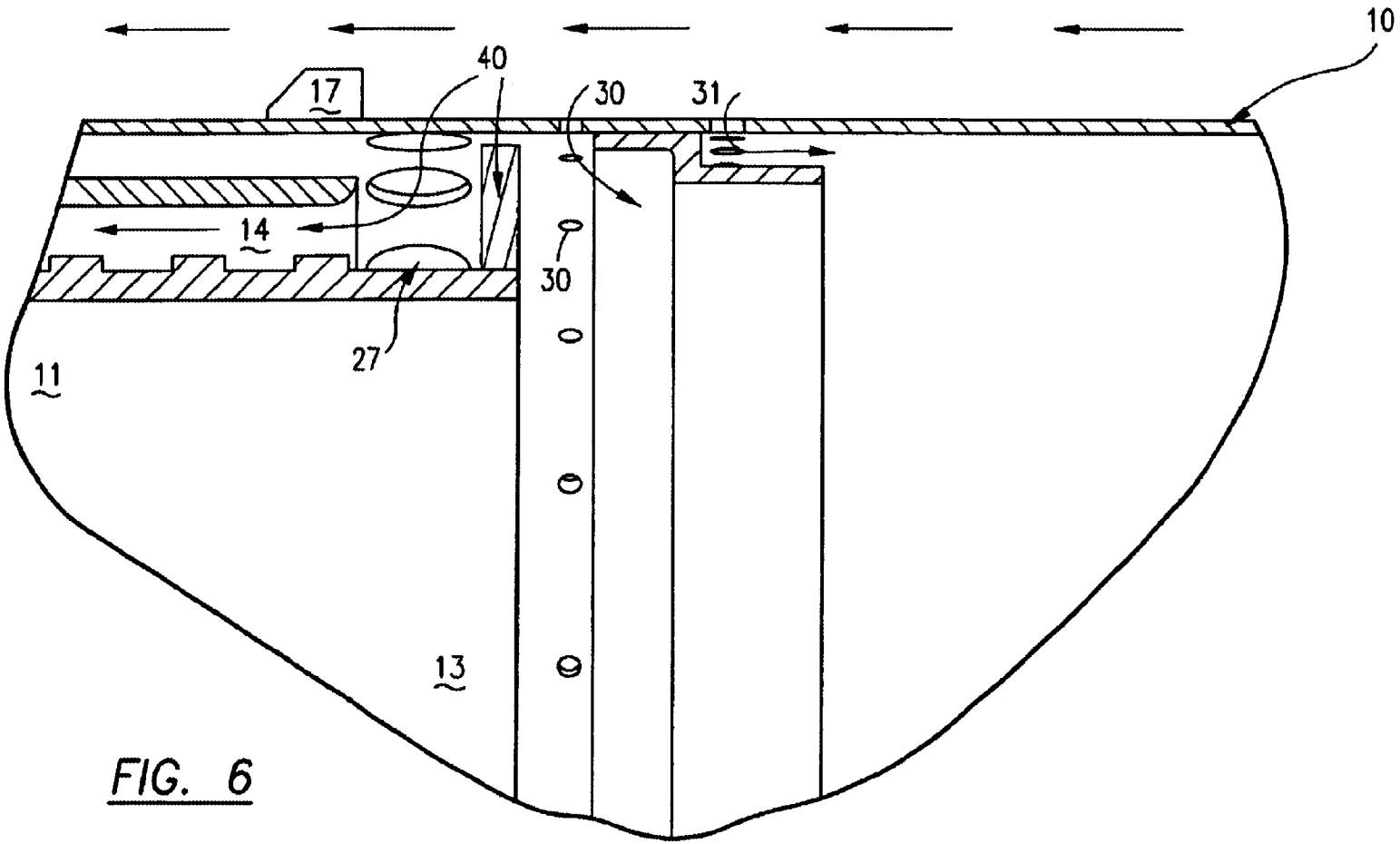
FIG. 6 is a cut away and enlarged view of the aft end of the combustion chamber wall in cross-section.

The outside of the combustor 10 is surrounded by a housing (not shown) and contains air under pressure that moves upstream towards the premix zone 12, the air being received from the compressor of the turbine. This is very high pressure air. The cooling air passageway 14 has air inlet apertures 27 which permit the high pressure air surrounding the combustor to enter through the apertures 27 and to be received in the first portion 45 of passageway 14 that surrounds the venturi 11. The cooling air passes along the venturi 11 passing the venturi converging and diverging walls and venturi throat 11*a*. Preheated cooling air exits through outlet apertures 28 which exit into an annular bellyband chamber 16 that defines a second portion 46 (FIG. 4) of the passageway 14. The combustor utilizes the cooling air that has been heated and allowed to enter into premix chamber 12 through apertures 29 and 22. Details are shown in FIGS. 5 and 6. Note that this is heated air that has been used for cooling that is now being introduced in the premix chamber, upstream of the convergent wall of the venturi and upstream of venturi throat 11*a*. Using preheated air drives the f/a ratio to a lean limit to reduce NOx while maintaining a stable flame.

Figure 4:
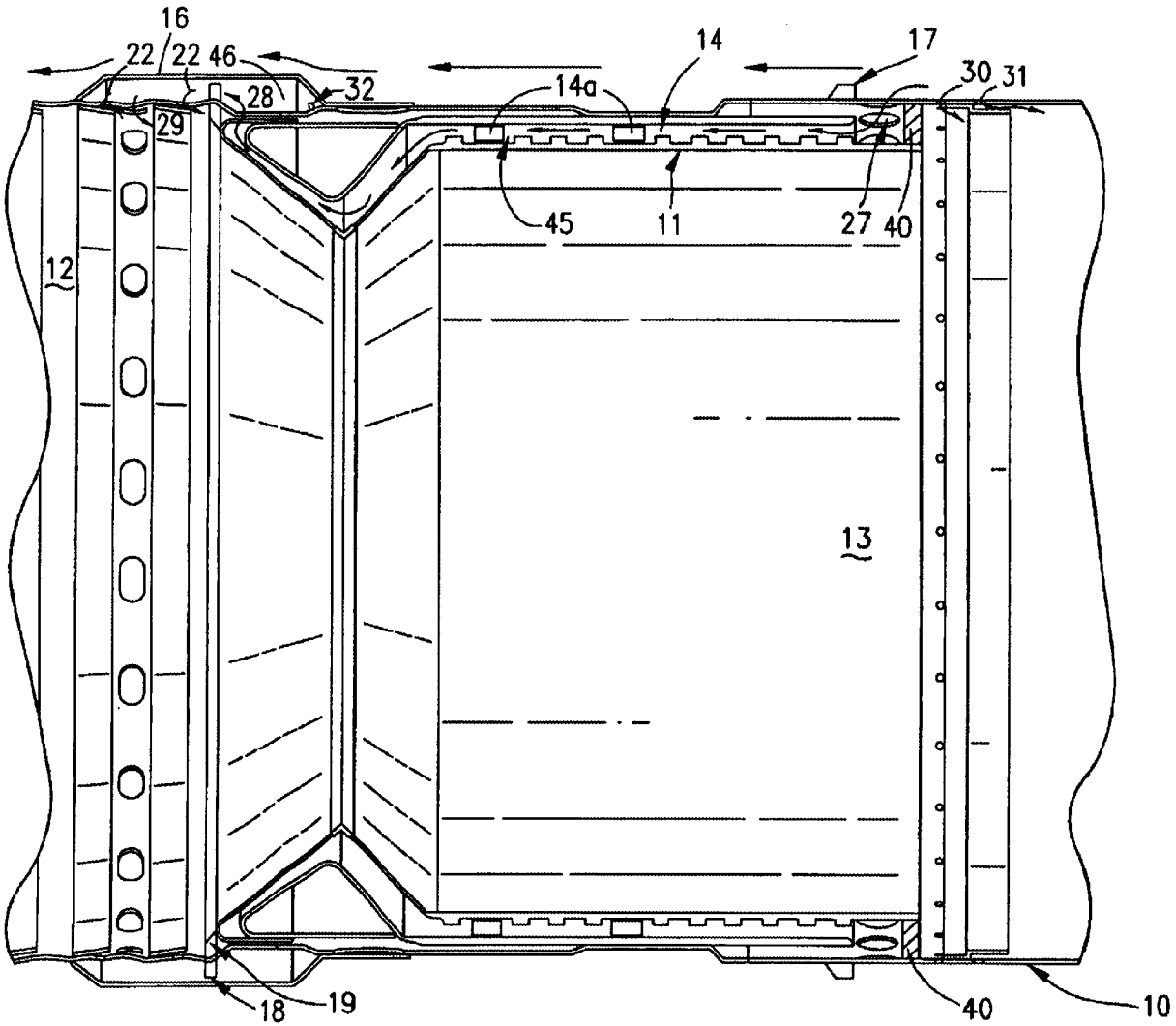
FIG. 4 shows a cut away version in cross section of the combustion chamber and venturi and portions of the premix chamber as utilized in the present invention.

Referring now to FIG. 4, the cooling air passageway 14 includes a first portion 45 having a plurality of spacers 14*a* that separate venturi 11 from wall 11*b*. The bellyband wall 16 defines a radially outer boundary of the second portion 46 of the passageway 14 and provides a substantially annular chamber that allows the outside pressure air and the exiting cooling air to be received into the premix chamber 12. At the downstream end of the combustion chamber 13, defined by the annular aft end of venturi 11, there is disposed an annular air blocking ring 40 which prevents any cooling air from leaking downstream into the combustion chamber. This alleviates any combustion problems caused by the cooling air as delineated in the prior art discussed above.

Referring now to FIG. 5 the air passageway 14 is shown along the venturi section having the convergent and divergent walls and the throat 11*a* with cooling air passing through and exiting through apertures 28 that go into the air chamber formed by bellyband wall 16. Additional air under a higher pressure enters through apertures 32 and forces air including the now heated cooling air in passageway 14 to be forced through apertures 22 and 29 into the premix chamber 12.

FIG. 6 shows the aft end portion of the combustion chamber 13 and the end of venturi 11 that includes the blocking ring 40 that is annular and disposed and attached in a sealing manner around the entire aft portion of the venturi 11. The cooling air that enters into passageway 14 cannot escape or be allowed to pass into any portions of the combustion chamber 13. Note that some air is permitted into the combustor 10 well beyond combustion chamber 13 through apertures 30 to 31 which are disposed around the outside of the combustor 10 and for cooling the aft end of the combustor.

The invention includes the method of improved cooling of a combustion chamber and venturi which allows the air used for cooling to increase the efficiency of the combustion process itself to reduce NOx emissions. With regard to the air flow, the cooling air enters the venturi outer passageway 14 through multiple apertures 27. A predetermined amount of air is directed into the passageway 14 by element 17. The cooling air is forced upstream by blocking ring 40 which expands to contact the combustor 10 under thermal loading conditions. The cooling air travels upstream through the convergent/divergent sections of the first portion 45 of passageway 14 where it exits into the second portion 46 of passageway 14 through apertures 28 in the venturi 11 and the combustor 10. The cooling air then fills a chamber created by a full ring bellyband 16. Due to the pressure drop and increase in temperature that has occurred throughout the cooling path, supply air which is at an increased pressure is introduced into the bellyband chamber 16 through multiple holes 32. See FIGS. 4 and 5. The cooling air passes around multiple elements 18 which are located throughout the bellyband chamber 16 for support of the bellyband under pressure. The cooling air is then introduced to the premix chamber through holes 22 and slots 29 in the combustor 10. Undesired leakage does not occur between the cooling passageway 14 and the premixing chamber 12 because of the forward support 19 which is fixed to the combustor 10 and venturi 11. The remainder of the cooling air not introduced to passageway 14 through apertures 27 passes over the element 17 and travels upstream to be introduced into the combustor 10 or cap 15. This air is introduced through multiple locations forward of the bellyband cavity 16.

It is through this process, rerouting air that was used for cooling and supplying it for combustion, that lowers the fuel to air ratio such that NOx is reduced without creating an unstable flame.

Figure 7:
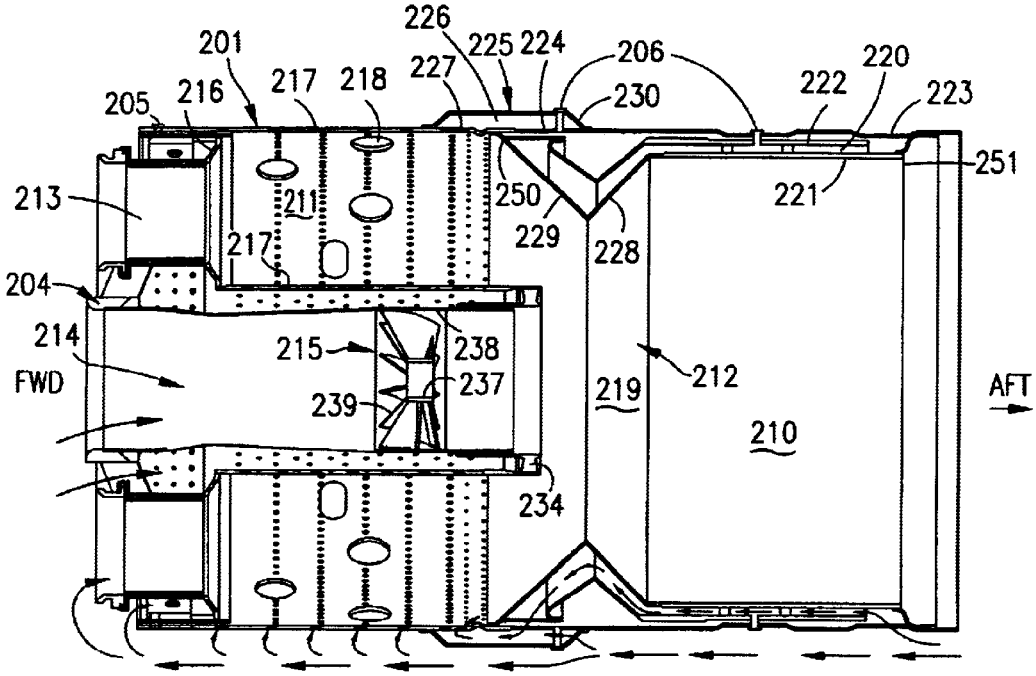
FIG. 7 PRIOR ART
FIG. 7 is a cross section view of a portion of a combustion system of the prior art.

Referring to back to FIGS. 6 and 7, alternate venturis are shown that utilize the improved cooling concept disclosed in the preferred embodiment. Cooling air enters the passageway 14 and 220 through first apertures 27 and 223, respectively. In the venturi configuration shown in FIG. 7, which is a venturi of the prior art, cooling air is drawn into passageway 220 through first apertures 223 due to the lower operating pressure within passageway 220 when compared to the pressure outside liner 201. It was determined that utilizing the pressure difference as the sole means for drawing cooling air into the passageway was not sufficient to provide the desired cooling to the passageway. Inadequate cooling of venturi 212 can result in increased operating temperatures, accelerated component degradation, and shorter component life. As a result, an air direction element 17 was added, as shown in FIG. 6, to liner 10 in order to increase the quantity of cooling air into passageway 14. While this device helped to increase the supply of cooling air to passageway 14, air pressure loss was still a concern requiring further improvements to be made to further increase the cooling air supply volume and raise cooling air supply pressure. A further increase in cooling air supply volume and total air pressure will result in lower venturi operating temperatures due to the greater capability to cool the hot walls of the venturi region. Lower metal temperatures within the venturi will result in a greater durability, longer component life, and hence lower operating costs.

Referring now to FIGS. 8–11, an alternate embodiment of the present invention is shown in detail. In this alternate embodiment, improvements have been made in the region surrounding the venturi cooling passageway to enhance cooling effectiveness. As with the preferred embodiment, and shown in FIGS. 8 and 9, a venturi 60 is positioned within liner 61 having a first generally annular wall 62 and outer surface 62A. Liner 61 contains a premix chamber 63 for mixing fuel and air and a combustion chamber 64 proximate venturi 60 such that premixing chamber 63 is in fluid communication with combustion chamber 64. First generally annular wall 62 contains at least one first aperture 65 and at least one second aperture 66, radially outward of premix chamber 63. It is preferable that both first aperture 65 and second aperture 66 comprise a plurality of first and second apertures spaced circumferentially about first generally annular wall 62. Liner 61 also contains an improved air direction element or deflector 85 which is fixed to outer surface 62A of first generally annular wall 62 proximate at least one first aperture 65 by a means such as brazing or welding. Deflector 85 is shown in greater detail in FIGS. 10 and 11 and comprises a generally annular ring having a forward end 86 and an aft end 87 in spaced relation to forward end 86 thereby defining a first length 88. Deflector 85 also contains an inner ring surface 89 and an outer ring surface 90 radially outward from inner ring surface 89 thereby defining a first height 91. Furthermore, deflector 85 includes a forward face 92 and an aft face 93, each of faces 92 and 93 extend from inner ring surface 89 to outer ring surface 90 and forward face 92 is spaced in relation to aft face 93. Aft face 93 also contains a first region of curvature 94 with a first radius R1. First length 88, first height 91, and first radius R1 vary in size depending on the size of the combustor and the amount of cooling air required to cool passageway 14. Typically first length 88 is at least 0.100 inches, first height 91 is at least 0.100 inches, and first radius R1 is at least 0.250 inches. Furthermore, in the preferred embodiment of deflector 85, forward face 92 further comprises a first member 95 which is generally perpendicular to inner ring surface 89 and a second member 96 which extends from first member 95 to outer ring surface 90 and is oriented at $\alpha$ pitch angle a relative to outer ring surface 90. In the preferred embodiment, pitch angle $\alpha$ is at least 5 degrees. Having a second member 96 with a pitch angle $\alpha$ such that second member 96 is directed towards first generally annular wall 62 of liner 61 encourages cooling air not entering passageway 14 and passing along outer ring surface 90 to "reattach" to the liner surface thereby increasing cooling along first generally annular wall 62 of liner 61.

Referring back to FIGS. 8 and 9, venturi 60 includes a second generally annular wall 67 having a first converging wall 68 abutting a first diverging wall 69 at a first plane 70 that is generally perpendicular to first generally annular wall 62. Venturi 60 further contains a throat portion 11A at first plane 70 such that throat portion 11A is positioned between premix chamber 63 and combustion chamber 64. Second generally annular wall 67 is positioned radially inward from first generally annular wall 62 and has an aft end 71 adjacent to at least one first aperture 65. Venturi 60 further includes a third generally annular wall 72 radially outward of second generally annular wall 67 and radially inward of first generally annular wall 62. Third generally annular wall 72 contains a second converging wall 73 and a second diverging wall 74 connected at a first region of curvature 75 proximate first plane 70 and having a second radius R2.

Figure 8:
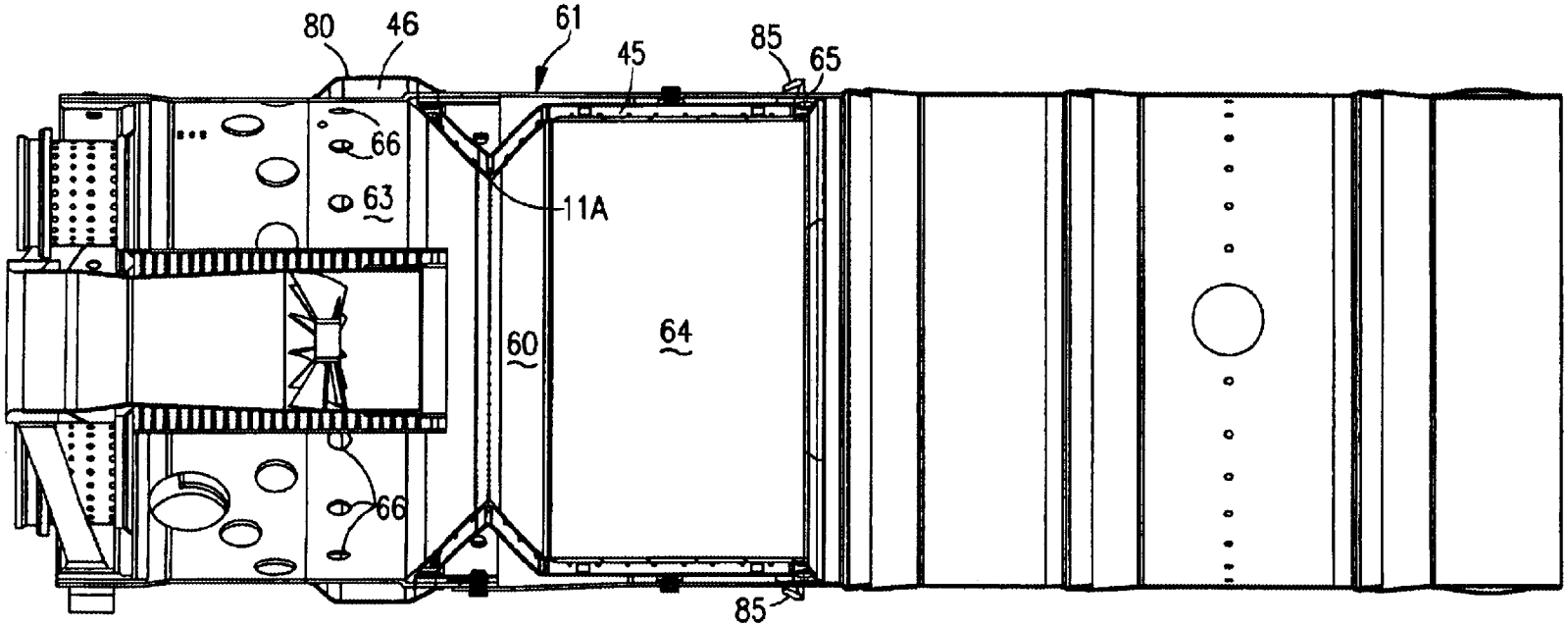
FIG. 8 is a cross section view of a combustion system incorporating the alternate embodiment of the present invention.
Figure 9:
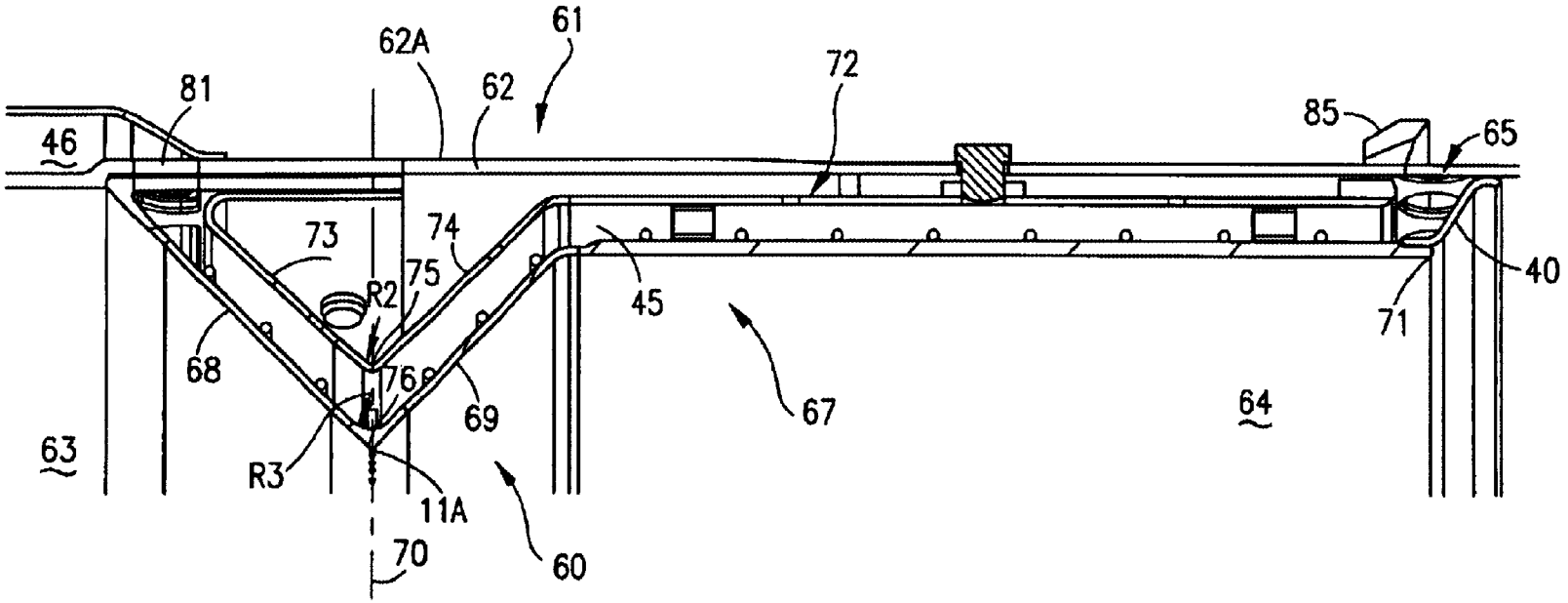
FIG. 9 is an enlarged cross section view of a portion of the combustion system of the alternate embodiment of the present invention.
Figure 10:
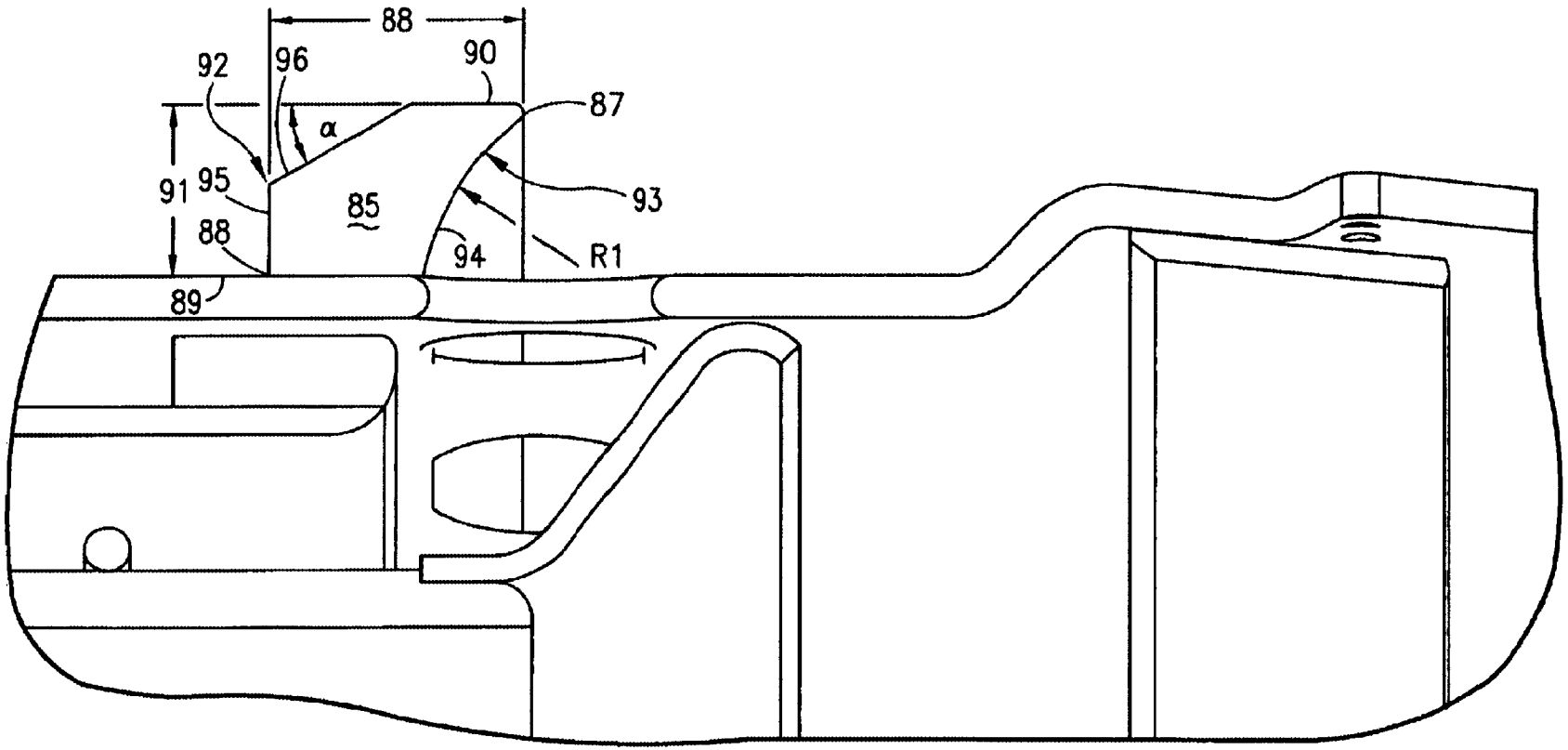
FIG. 10 is an enlarged cross section view of the aft end of the venturi and combustion liner in accordance with the alternate embodiment of the present invention.
Figure 11:
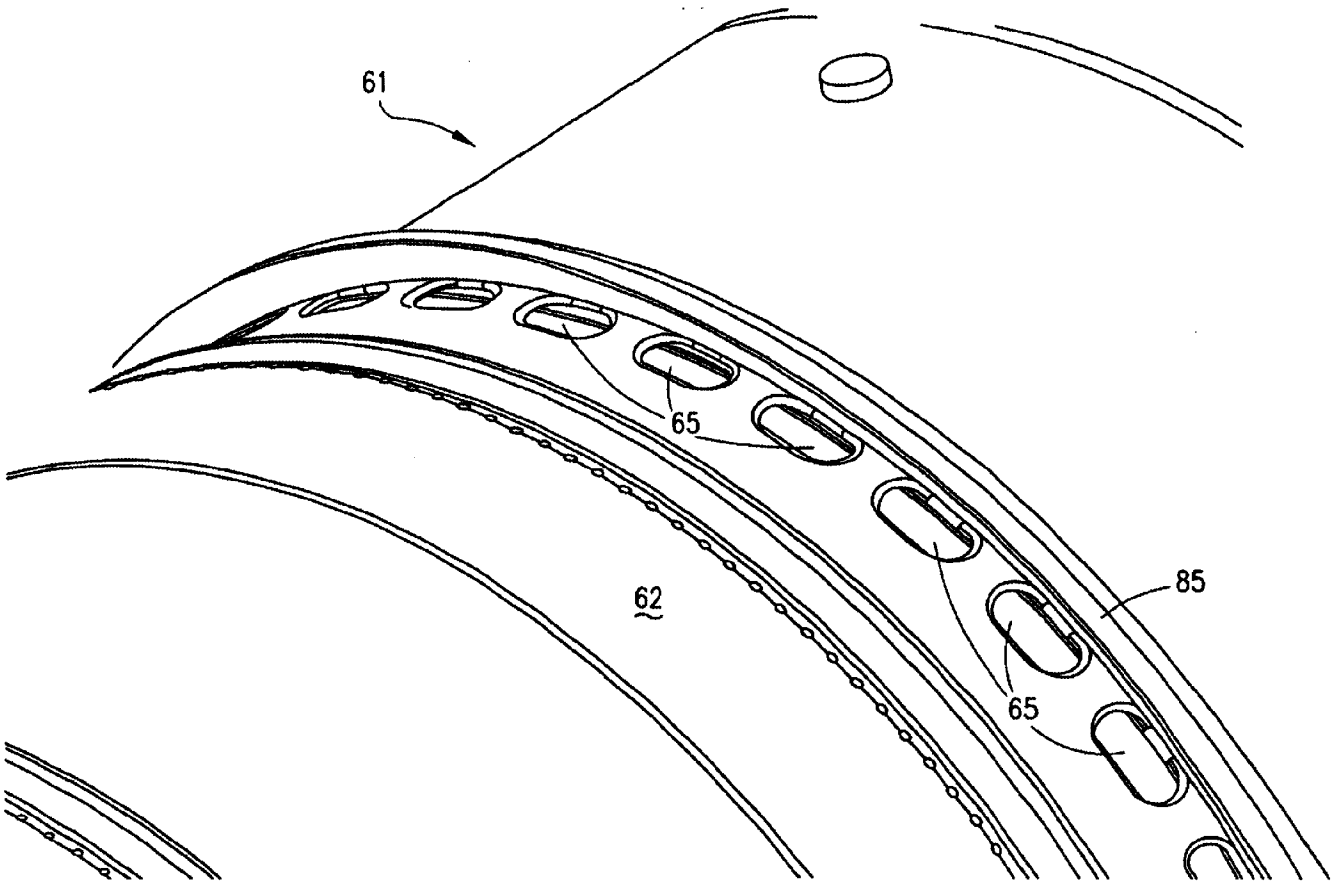
FIG. 11 is a perspective view of the aft portion of the combustion system in accordance with the alternate embodiment of the present invention.

Venturi 60 also contains a passageway 14 for flowing air to cool second generally annular wall 67. Passageway 14 extends from at least one first aperture 65 to at least one second aperture 66 in liner 61. Passageway 14 includes a first portion 45 located radially inward from third generally annular wall 72 and radially outward of second generally annular wall 67 as well as a second portion 46 radially outward of first portion 45 where second portion 46 extends from first portion 45 to at least one second aperture 66, as shown in FIG. 8. A substantially annular bellyband wall 80 is located radially outward from first generally annular wall 62 thereby defining the radially outer boundary of second portion 46 of passageway 14. At least one third aperture 81 is located in first generally annular wall 62 and communicates with second portion 46. It is preferable that at least one third aperture 81 comprises a plurality of third apertures which are spaced circumferentially about first generally annular wall 62 and radially outward of venturi 60 for communicating cooling flow from first portion 45 with second portion 46. Further characteristics of passageway first portion 45, which are shown in FIGS. 9 and 10, include at least one first aperture 65 located radially outward of first portion 45 and first portion 45 having a third region of curvature 76 with radius R3 proximate throat region 11A. In the preferred configuration of this alternate embodiment second radius R2 is smaller than third radius R3 with third radius R3 being at least 0.150 inches.

Extending from aft end 71 is a blocking ring 40 that is in sealing contact with first generally annular wall 62. Blocking ring 40 is utilized to prevent cooling air that is in first portion 45 of passageway 14 from flowing directly into combustion chamber 64 without first flowing through second portion 46 of passageway 14 and into premix chamber 63.

Through utilizing this venturi structure, not only are emissions reduced by improving overall combustion efficiency through introducing cooling air from passage 14 into the combustion process, but cooling effectiveness within passageway 14 is improved due to an improved air deflector design directing additional cooling air with a greater total air pressure into first apertures 65.

While the invention is been described and is known as presently the preferred embodiment, it is to be understood that the invention is not to be limited to the disclosed embodiment but, on the contrary, it is intended to cover various modifications and equivalent arrangements within the scope of the following claims.

What we claim is:

1. An improved low emission (NOx) combustor for use with gas turbine engine comprising:

a liner having a first generally annular wall with an outer surface and including a premix chamber for mixing fuel and air and a combustion chamber for combusting said fuel and air, said premix chamber in communication with said combustion chamber, said first generally annular wall having at least one first aperture and at least one second aperture, said second aperture being radially outward of said premix chamber, and a deflector fixed to said outer surface of said first generally annular wall proximate said at least one first aperture, said deflector comprising:

a generally annular ring having a forward end, an aft end in spaced relation to said forward end thereby defining a first length therebetween, an inner ring surface, an outer ring surface radially outward from said inner ring surface thereby defining a first height, a forward face, an aft face, each of said faces extending from said inner ring surface to said outer ring surface, said forward face in spaced relation to said aft face, said aft face having a first region of curvature with a first radius R1;

a venturi having a second generally annular wall that includes a first converging wall and a first diverging wall, said first converging wall abutting said first diverging wall at a first plane, said first plane generally perpendicular to said first generally annular wall, said venturi further containing a throat portion at said first plane, said throat portion being positioned between said premix chamber and said combustion chamber, said second generally annular wall being radially inward from said first generally annular wall and having an aft end adjacent said at least one first aperture, said venturi having a third generally annular wall being radially outward of said second generally annular wall and radially inward of said first generally annular wall, said third generally annular wall including a second converging wall and a second diverging wall, said second converging wall connected to said second diverging wall at a second region of curvature proximate said first plane and having a second radius R2;

a passageway for flowing cooling air through said venturi, said passageway extending from said at least one first aperture to said at least one second aperture, said passageway including a first portion radially inward from said third generally annular wall and radially outward from said second generally annular wall, and said passageway including a second portion radially outward from said first portion of said passageway, said second portion extending from said passageway first portion to said at least one second aperture, and said first aperture being radially outward from said first portion, and said first portion of said passageway having a third region of curvature with radius R3 proximate said throat; and, a blocking ring extending from said aft end of said second generally annular wall to said first generally annular wall in sealing contact therewith, said blocking ring preventing cooling air that is in said first portion of said passageway from flowing directly into said combustion chamber without flowing through said second portion of said passageway;

wherein said aft face of said deflector directs cooling air into said passageway through said at least one first aperture and said passageway communicates with said premix chamber through said at least one second aperture, such that cooling air, after being heated by cooling said venturi, exits from said passageway into the premix chamber thereby increasing the efficiency of the combustion process and reducing NOx emissions.

2. The low emission combustor of claim 1 wherein said first length of said deflector is at least 0.100 inches.

3. The low emission combustor of claim 1 wherein said first height of said deflector is at least 0.100 inches.

4. The low emission combustor of claim 1 wherein said forward face of said deflector further comprises a first member generally perpendicular to said inner ring surface and a second member extending from said first member to said outer ring surface and oriented at a pitch angle a relative to said outer ring surface.

5. The low emission combustor of claim 4 wherein said pitch angle a of said second member relative to said outer ring surface is at least 5 degrees.

6. The low emission combustor of claim 1 wherein said first radius R1 is at least 0.250 inches.

7. The low emission combustor of claim 1 wherein said deflector is fixed to said outer surface of said first generally annular wall by a means such as brazing.

8. The low emission combustor of claim 1 wherein said deflector is fixed to said outer surface of said first generally annular wall by a means such as welding.

9. The low emission combustor of claim 1 wherein said second radius R2 is less than said third radius R3.

10. The low emission combustor of claim 9 wherein said third radius R3 is at least 0.150 inches.

11. The low emission (NOx) combustor of claim 1 further including a substantially annular bellyband wall radially outward from the first generally annular wall, and at least one third aperture in said first generally annular wall, said first portion of said passageway communicating with said second portion of said passageway through said third aperture, wherein said bellyband wall defines a radially outer boundary of the second portion of the passageway.

12. The low emission (NOx) combustor as in claim 11 wherein said at least one first aperture comprises a plurality of first apertures spaced circumferentially about the first generally annular wall, and each of said first apertures is radially outward of the first portion of the passageway.

13. The low NOx emission combustor of claim 12 wherein said at least one second aperture comprises a plurality of second apertures spaced circumferentially about the first generally annular wall, and each of said second apertures is radially outward of the premix chamber.

14. The low NOx emission combustor as in claim 13 wherein said at least one third aperture comprises a plurality of third apertures spaced circumferentially about the first generally annular wall, and each of said third apertures is radially outward of the venturi.

* * * * *